US009582973B2

(12) United States Patent
Leonard

(10) Patent No.: US 9,582,973 B2
(45) Date of Patent: Feb. 28, 2017

(54) ILLUMINATED SAFETY DEVICE FOR ATTACHMENT TO AN ARTICLE OF CLOTHING

(71) Applicant: L2 Strategies LLC, Arlington, VA (US)

(72) Inventor: Lisa Leonard, Arlington, VA (US)

(73) Assignee: L2 Strategies LLC, Arlington, VA (US)

( * ) Notice: Subject to any disclaimer, the term of this patent is extended or adjusted under 35 U.S.C. 154(b) by 143 days.

(21) Appl. No.: 14/502,756

(22) Filed: Sep. 30, 2014

(65) Prior Publication Data

US 2016/0091183 A1 Mar. 31, 2016

(51) Int. Cl.

| | |
|---|---|
| ***F21L 4/00*** | (2006.01) |
| ***G08B 5/00*** | (2006.01) |
| *A41D 13/01* | (2006.01) |

(52) U.S. Cl.

CPC ..... *G08B 5/004* (2013.01); *A41D 13/01* (2013.01)

(58) Field of Classification Search

CPC ..... A41D 27/085; A41D 27/08; A41D 13/01; F21V 21/0965; F21V 33/0076; F21W 2111/10

USPC ..... 362/190, 103, 184, 191, 200

See application file for complete search history.

(56) References Cited

U.S. PATENT DOCUMENTS

| | | | | |
|---|---|---|---|---|
| 5,249,106 | A | 9/1993 | Barnes et al. | |
| 6,170,959 | B1 | 1/2001 | Richardson, III | |
| 6,193,385 | B1 | 2/2001 | Maki et al. | |
| 6,267,482 | B1 | 7/2001 | Miller et al. | |
| 6,834,395 | B2 | 12/2004 | Fuentes | |
| 6,874,924 | B1 | 4/2005 | Hulse et al. | |
| 6,964,493 | B1 | 11/2005 | Whitlock | |
| 7,377,663 | B2 | 5/2008 | Desjardin | |
| 7,703,963 | B2 * | 4/2010 | Feng | G02B 6/001 349/65 |
| 7,854,021 | B2 * | 12/2010 | Compton | G09F 21/02 2/243.1 |
| 8,142,062 | B2 | 3/2012 | Jablonski | |

(Continued)

FOREIGN PATENT DOCUMENTS

| | | | |
|---|---|---|---|
| CN | 203290256 | U | 11/2013 |
| WO | WO-03/020064 | A1 | 3/2003 |
| WO | WO-2005/060309 | A2 | 6/2005 |

*Primary Examiner* — Bryon T Gyllstrom

(74) *Attorney, Agent, or Firm* — Craige Thompson; Thompson Patent Law

(57) ABSTRACT

Apparatus and associated methods relate to a reflectively-illuminated safety symbol attachable to an article of clothing. In accordance with an exemplary embodiment, a safety device may include a first side of reflective material and a second side of reflective material. Each side of reflective material may be separately illuminated by a light source positioned between the two sides, such as for example one or more strings of LEDs. In some embodiments, the first side is a first color and the second side is a second color. In some embodiments, the safety device may provide for removable attachment to an article of clothing. For example, the safety device may utilize a magnetic attachment. In another exemplary embodiment, the safety symbol may utilize a hook and loop attachment. In various embodiments, the safety device may provide for an increased awareness of a wearer through removable attachment of an illuminated safety symbol.

20 Claims, 7 Drawing Sheets

(56) References Cited

U.S. PATENT DOCUMENTS

| | | | | |
|---|---|---|---|---|
| 8,313,214 | B2 * | 11/2012 | Liang | F21V 7/0016 362/235 |
| 8,616,719 | B1 | 12/2013 | Barze | |
| 2002/0163791 | A1 * | 11/2002 | Hoelen | G02B 6/0076 362/616 |
| 2003/0079387 | A1 * | 5/2003 | Derose | G02B 6/0083 40/544 |
| 2003/0193799 | A1 * | 10/2003 | Bohler | F21S 8/00 362/240 |
| 2004/0047146 | A1 | 3/2004 | Galoob et al. | |
| 2006/0072337 | A1 * | 4/2006 | Tseng | G02F 1/133615 362/600 |
| 2007/0291473 | A1 | 12/2007 | Traynor | |
| 2009/0059615 | A1 | 3/2009 | Wainright | |
| 2009/0073673 | A1 * | 3/2009 | Young | G09F 13/14 362/97.1 |
| 2010/0253501 | A1 | 10/2010 | Gibson | |
| 2010/0313328 | A1 | 12/2010 | Shelton et al. | |
| 2011/0317429 | A1 * | 12/2011 | Aiba | H01L 51/5265 362/296.01 |
| 2012/0170283 | A1 * | 7/2012 | Kobayashi | G06F 3/041 362/351 |

* cited by examiner

ILLUMINATED SAFETY DEVICE FOR ATTACHMENT TO AN ARTICLE OF CLOTHING

TECHNICAL FIELD

Various embodiments relate generally to a safety device and more particularly to an illuminated safety device for attachment to an article of clothing to increase a wearer's visibility.

BACKGROUND

A recent awareness in people's health has increased the number of individuals exercising by running, jogging, walking, hiking, sitting, or biking on streets, sidewalks, and other public places. Because of people's busy schedules, individuals choose to or are forced to exercise during low lit hours of the day, such as dusk or dawn thus resulting in a lessened chance of passing vehicles seeing the individuals and a greater chance of the passing vehicles colliding with the pedestrian. Further, national statistics show that almost fifty percent of individual fatalities occur between the hours of 6 p.m. and midnight.

Attempts to make pedestrian more visible have resulted in individuals wearing bright or reflective colored clothing, gloves, and/or carrying a flashlight, for example. However, for various exemplary reasons, such as the clothing blending into the surrounding environment, the reflective material covering only a small area of the wearer's body, or the clothing or individual being hidden from a vehicle driver's view, the bright colored clothing is not always a satisfactory method of alerting the vehicle driver of the pedestrian's presence. The danger for the pedestrian is compounded in that many drivers unfortunately don't pay enough attention to their surroundings and individuals can be especially hard to see amongst oncoming headlights. This results in an increased risk of a collision with the vehicle and the pedestrian.

Other safety devices may include reflective material embedded in the wearer's clothing. These safety devices can result in heavy and awkwardness of the clothing, as well as difficulty in maneuvering while wearing the clothing, and difficulty in cleaning the clothing. Improvement of safety devices and related articles for individuals running, jogging, walking, hiking, sitting, or biking on streets, sidewalks, and other public places can yield drastic reductions in road accidents and fatalities and are thus highly desirable.

SUMMARY

Apparatus and associated methods relate to a reflectively-illuminated safety symbol attachable to an article of clothing. In accordance with an exemplary embodiment, a safety device may include a first layer of reflective material and a second layer of reflective material. Each layer of reflective material may be separately illuminated by a light source positioned between the two layers, such as for example one or more strings of LEDs. In some embodiments, the first layer is a first color and the second layer is a second color. In some embodiments, the safety device may provide for removable attachment to an article of clothing. For example, the safety device may utilize a magnetic attachment. In another exemplary embodiment, the safety symbol may utilize a hook and loop attachment. In various embodiments, the safety device may provide for an increased awareness of a wearer through removable attachment of an illuminated safety symbol.

In accordance with an exemplary embodiment, a dual-sided reflectively-illuminated safety symbol may provide for a first colored illumination on a first layer and a second colored illumination on a second layer. For example, a first layer may be formed of an orange reflective material, such that when an internal light source illuminates the first layer an orange-colored light is emitted. Likewise, a second layer may be formed of a yellow reflective material, such that when an internal light source illuminates the second layer a yellow-colored light is emitted. In some embodiments, the safety device is in the shape of a safety symbol, such as for example a warning triangle. The light source may be powered through an internal power supply. For example, a battery compartment may be located central to the warning triangle, such as within a hollow center of the triangle.

Various embodiments may achieve one or more advantages. For example, some embodiments may permit for removable attachment of the safety device to a particular article of clothing. For example, one safety device may be interchangeable and transferrable between multiple items of clothing. The safety device may be transferred between articles of clothing without permanently altering the clothing. For example, in a magnetic attachment configuration, the clothing may be sandwiched between two magnets, one being an external magnet to the safety device and one being an internal magnet to the safety device. Some embodiments may permit for the emitting of either an orange light or a yellow light depending on the orientation of the safety device. The emitting of different colors may be advantageous in that orange light may be more visible in low-light or night-time applications and yellow light may be more visible in day-time applications. Some embodiments may permit for various patterns of light illumination to provide a particular level of awareness, such as a constant illumination or a flashing illumination.

The details of various embodiments are set forth in the accompanying drawings and the description below. Other features and advantages will be apparent from the description and drawings, and from the claims.

DETAILED DESCRIPTION OF ILLUSTRATIVE EMBODIMENTS

To aid understanding, this document is organized as follows. First, the exemplary safety device is briefly introduced with reference to FIG. 1. Second, with reference to FIGS. 2A-2B, the discussion turns to exemplary embodiments that illustrate front and rear outer layers of the exemplary safety device. Then, with reference to FIGS. 3-4, various mounting assemblies are illustrated for providing removable attachment of the safety device to an article of clothing. Finally, with reference to FIG. 5, the safety device is shown as being attached to a backpack to illustrate the attachment versatility of the safety device.

Figure 1:
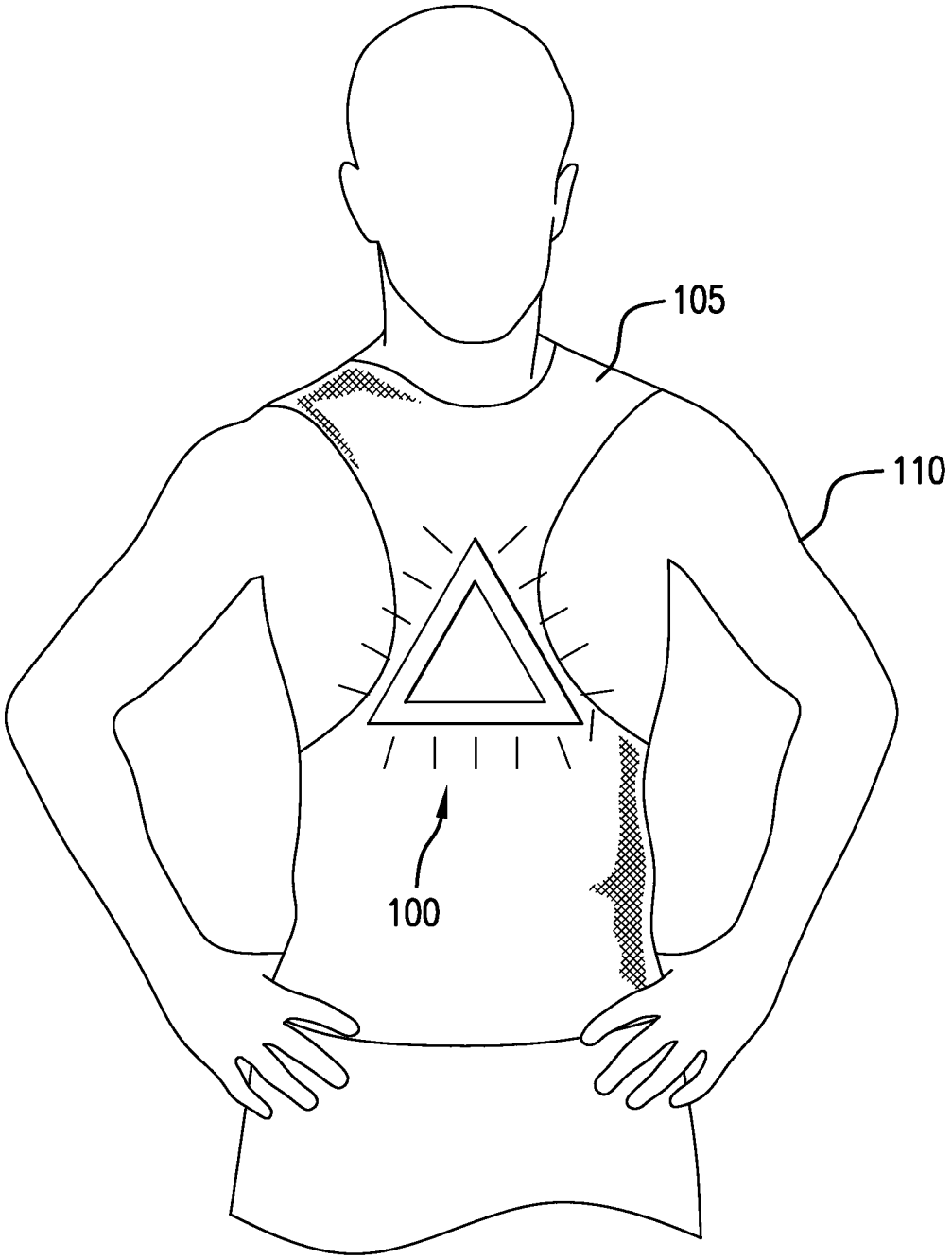
FIG. 1 depicts an exemplary safety device being worn by an individual.

FIG. 1 depicts an exemplary safety device being worn by an individual. In the exemplary embodiment, a lightweight safety device 100 in the shape of a warning symbol is attached to an article of clothing 105 worn by an individual 110. The shape of the safety device 100 is further a warning triangle shape. The safety device 100 emits light along a perimeter such that a triangular illumination is portrayed. In an exemplary embodiment, the shape of the safety device 100 is modeled after the internationally known triangular which signifies yield. Symbols may provide instant communication with roadway users, as well as overcome language barriers. Familiarity with symbols on traffic signs is important for every road user in order to maintain the safety and efficiency of our transportation facilities. The safety device 100 fashions its shape after the regulatory signage, such as for example the inverted triangles for "yield".

Other shapes of the safety device 100 may be appreciated. For example, the safety device 100 may be shaped similar to a stop sign common on roadways. In another exemplary embodiment, the safety device 100 may emit light in a word pattern, such as for example emit light to display the word "caution" or "stop".

The safety device 100 is shown as attached to the back of the article of clothing 105, such that vehicles or other individuals 110 can view the safety device 100 from behind the individual 110. In another exemplary embodiment, a safety device 100 may be attached to the front side of the individual's 110 clothing 105. In another exemplary embodiment, the safety device 100 may be attached to a backpack. In another exemplary embodiment, the safety device 100 may be attached to a child's stroller. The safety device 100 may be removably attached to the clothing 105, such as to permit the individual 110 to remove the safety device 100 after use, or reattach to another article of clothing 105, for example. In an exemplary embodiment, the safety device 100 is lightweight, such as to be unrestrictive to the individual 110 when in use.

Figure 2A:
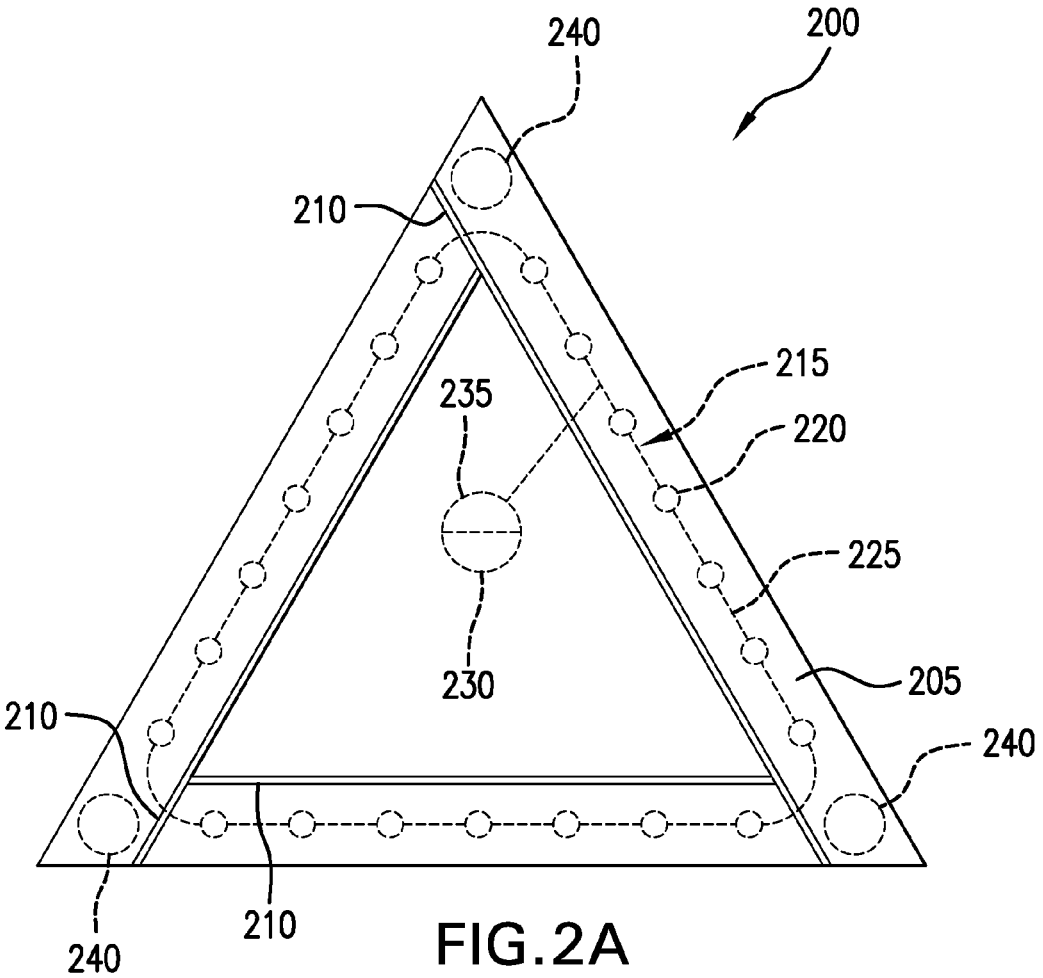
FIGS. 2A-2B depict front and rear sides of an exemplary safety device.
Figure 2B:
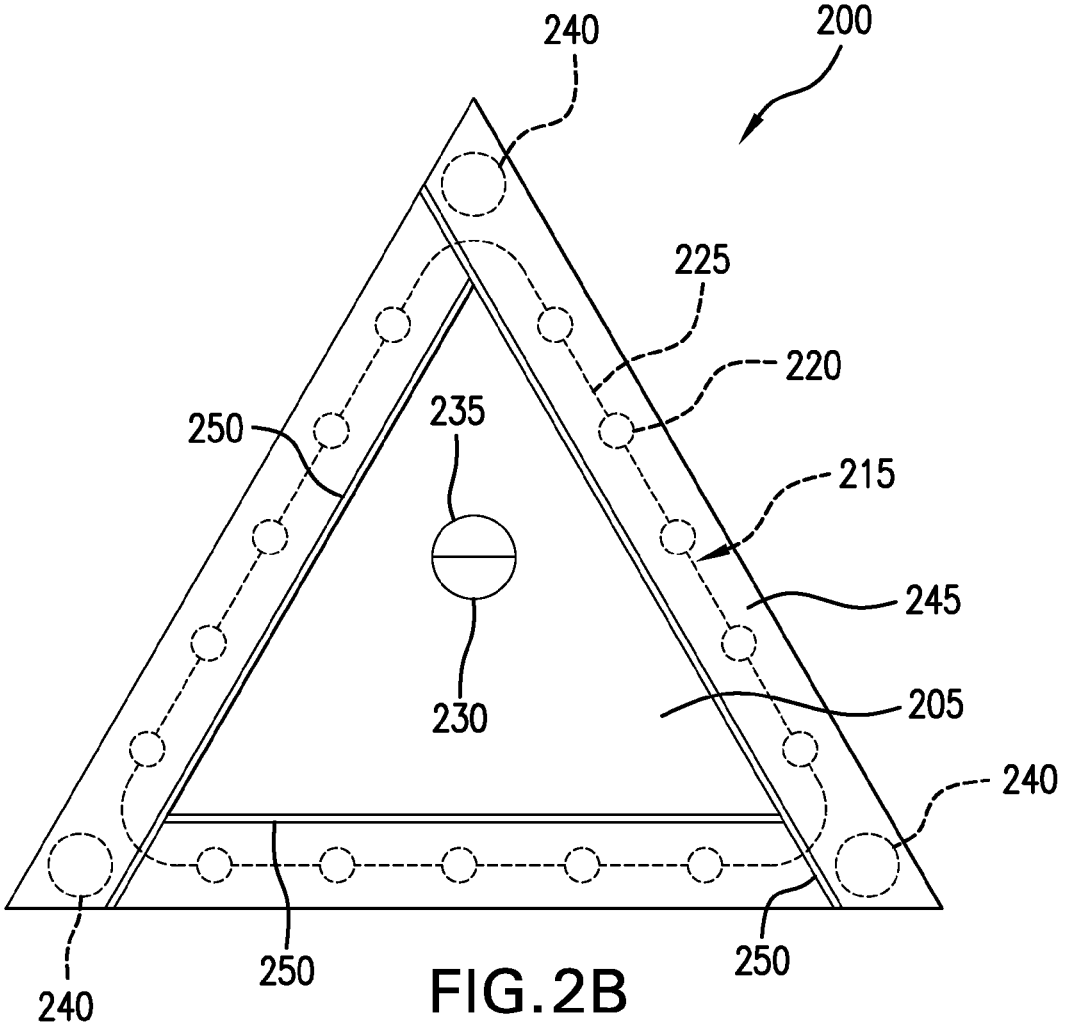

FIG. 2A-2B depict front and rear views of an exemplary safety device. In FIG. 2A, a first layer 205 upon a first side of the safety device 200 is portrayed. The first layer 205 may be formed of a reflective material such that portions of the light passing through the first layer 205 may be reflected or diffused outwards to form a glowing structure. In another exemplary embodiment, the first layer 205 may be formed of a translucent material to permit light passage therethrough. In some exemplary embodiments, the first layer 205 may include translucent and reflective properties. The material of the first layer 205 may be of a particular first color, for example a bright or fluorescent color. In an exemplary embodiment, the first color is comprised of an orange color, such that light transmitted through the first layer 205 is fluorescent orange.

The safety device 200 may include stitching 210 patterns, such as for example to contain or hold the internal lighting assembly 215. In the exemplary embodiment, the lighting assembly 215 follows a triangular perimeter of the safety device 200 and first layer 205. The stitching 210 may limit movement of the lighting assembly 215, such as for example to retain the lighting assembly 215 in a particular pattern or orientation. In some examples, the lighting assembly 215 emits a light in a triangular shape with a hollow center.

In the exemplary embodiment, the lighting assembly 215 is comprised of an LED (light emitting diode) string 215. The LED string 215 has a plurality of LEDs 220 connected by insulated electrical wires 225. The LED string 215 is powered by a power supply 230 which is controlled by an internal controller 235. The controller 235 may control a current flow or signal to the LED string 215 for turning the LEDs 220 on and off. In an exemplary embodiment, the controller 235 may include functionality to enable an LED 220 blinking pattern. In another exemplary embodiment, the controller 235 may enable an LED 220 timed pattern. In some exemplary embodiments, the controller 235 may be connected to a photocell for automatically enabling the LEDs 220 when an ambient light level is low. As depicted in the exemplary FIG. 2A, the LED string 215, controller 235, and power supply 230 are secured beneath the first layer 205 of the safety device 200.

The safety device 200 also includes an attachment structure 240. In the depicted example, the attachment structure 240 is comprised of a plurality of magnets. In an exemplary embodiment, the magnets 240 are neodymium magnets. The magnets 240 may permit removable attachment of the safety device 200 to an object, such as for example an article of clothing. In the depicted example, the magnets 240 are secured beneath the first layer 205 of the safety device 200. In an exemplary embodiment, the magnets 240 embedded within the safety device 200 magnetically attract to a second set of magnets (not shown) located on an opposite side of a host layer (E.g. shirt). The two sets of magnets 240 sandwich the host layer therebetween to retain the safety device 200 against the host layer.

In FIG. 2B, a second layer 245 upon a second side of the safety device 200 is portrayed. The second layer 245 may be formed of a reflective material such that portions of the light passing through the second layer 245 may be reflected or diffused outwards to form a glowing structure. In another exemplary embodiment, the second layer 245 may be formed of a translucent material to permit light passage therethrough. In some exemplary embodiments, the second layer 245 may include translucent and reflective properties. The material of the second layer 245 may be of a particular second color, for example a bright or fluorescent color. In an exemplary embodiment, the second color is comprised of a yellow color, such that light transmitted through the second layer 245 is fluorescent yellow.

In some exemplary embodiments, the first layer 205 and the second layer 245 may be comprised of similar materials, yet be of different colors. For example, a user may attach the safety device 200 to an article of clothing with the first layer 205 facing outwards to emit a first colored light, or may attach the safety device 200 to an article of clothing with the second layer 245 facing outwards to emit a second colored light. In some embodiments, the first layer 205 and the second layer 245 may be formed of similar shapes, such as for example a triangular shape. In some embodiments, the first layer 205 and the second layer 245 may incorporate different shapes.

Like the first layer 205, the second layer 245 may include a stitching 250 pattern, such as for example to contain or hold the internal lighting assembly 215. In some exemplary embodiments, the stitching 250 assembly of the first layer 205 and the stitching 250 assembly of the second layer 245 are shared. In the exemplary embodiment, the lighting assembly 215 follows a triangular perimeter of the safety device 200 and second layer 245. As depicted in the exemplary FIG. 2B, the LED string 215 is secured beneath the second layer 245 of the safety device 200. The controller 235 and power supply 230 are secured to the backside of the first layer 205. In some embodiments, the second layer 245 covers the controller 235 and the power supply 230 such that the controller 235 and the power supply 230 are enclosed between the first layer 205 and the second layer 245. In the depicted example of FIG. 2B, the magnets 240 are secured beneath the second layer 245 of the safety device 200, and thus between the first layer 205 and the second layer 245.

Figure 3:
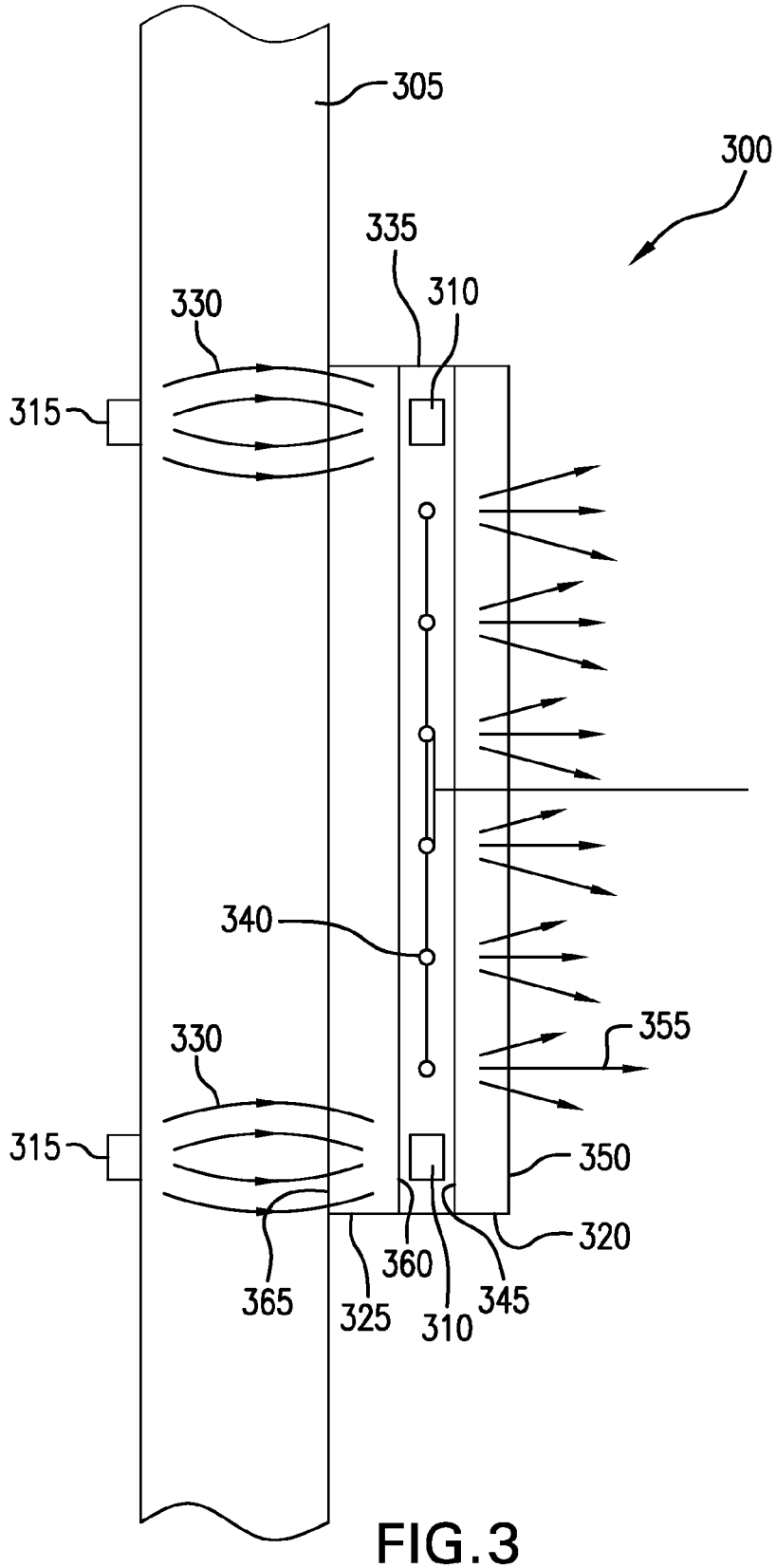
FIG. 3 depicts a side cross-sectional of an exemplary safety device attached to an article of clothing.

FIG. 3 depicts a side cross-sectional of an exemplary safety device attached to an article of clothing. The safety device 300 is portrayed as being removably attached to an article of clothing 305 via a first set of magnets 310 and a second set of magnets 315. The first set of magnets 310 is embedded between a first layer 320 and a second layer 325 of the safety device 300. The second set of magnets 315 is positioned along an inside surface of the article of clothing 305 such that each second magnet 315 is attracted to a respective first magnet 310 of the safety device 300 as depicted by the magnetic field 330. In an exemplary embodiment, after use or during storage of the safety device 300, the second magnets 315 may be stored by positioning the second magnets 315 against the first magnets 310 such that the first magnets 310 and the second magnets 315 magnetically attract to each other.

As shown, the magnets 310 are held within a center layer 335 between the outer first layer 320 and second layer 325. In an exemplary embodiment, the center layer 335 includes a shape retaining structure, such as for example a plastic sheet shaped similar to the first layer 320 and the second layer 325. The first layer 320 and the second layer 325 may be attached to the center layer 335. The center layer 335 may secure the first magnets 310 along with a lighting assembly 340. In another exemplary embodiment, the first layer 320 and the second layer 325 may themselves retain the first magnets 310 and lighting assembly 340 in place by tightly sandwiching the first magnets 310, lighting assembly 340, and other circuitry therebetween. By tightly sandwiching the layers, the overall width and weight of the safety device 300 may be minimized.

The first layer 320 includes an interior surface 345 and an exterior surface 350. In some embodiments, the exterior surface 350 may be reflective. In some embodiments, the exterior surface 350 may be shaped such as to reflect emitted light 355 passing through the first layer 320. In some examples, the exterior surface 350 may reflect ambient light, such as for example moonlight or vehicle headlights. The first layer 320 may be translucent such that a diffused or glowing pattern may be emitted from the first layer 320. In some examples, the light 355 emitted through the first layer 320 may be of a first color representative of the color of the first layer 320.

The second layer 325 includes an interior surface 360 and an exterior surface 365. In some embodiments, the exterior surface 365 may be reflective. In some embodiments, the exterior surface 365 may be shaped such as to reflect emitted light passing through the second layer 325. In some examples, the exterior surface 365 may reflect ambient light, such as for example moonlight or vehicle headlights. The second layer 325 may be translucent such that a diffused or glowing pattern may be emitted from the second layer 325. In some examples, the light emitted through the second layer 325 may be of a second color representative of the color of the second layer 325.

The depicted example illustrates light 355 being emitted through the first layer 320. If light were desired to be emitted through the second layer 325, such as for example to emit a different color, the safety device 300 is pulled away from the article of clothing 305 with a force to overcome the magnetic attracting force of the first and second set of magnets 310, 315. The safety device 300 is then flipped around such that the first layer 320 faces the article of clothing 305 and the second layer 325 faces outwards. The safety device 300 is positioned against the article of clothing 305 to align the first and second set of magnets 310, 315. Once the first and second set of magnets 310, 315 magnetically attract, the safety device 300 is secured to the article of clothing 305 and may be released.

Although not depicted, the lighting assembly 340 may also continuously emit light through the layer 320, 325 facing the article of clothing 305 as well as the layer 320, 325 directed outwards from the clothing 305; however the light emitted towards the clothing 305 is substantially blocked by the clothing 305 thus limiting light from escaping from behind the safety device 300.

Figure 4:
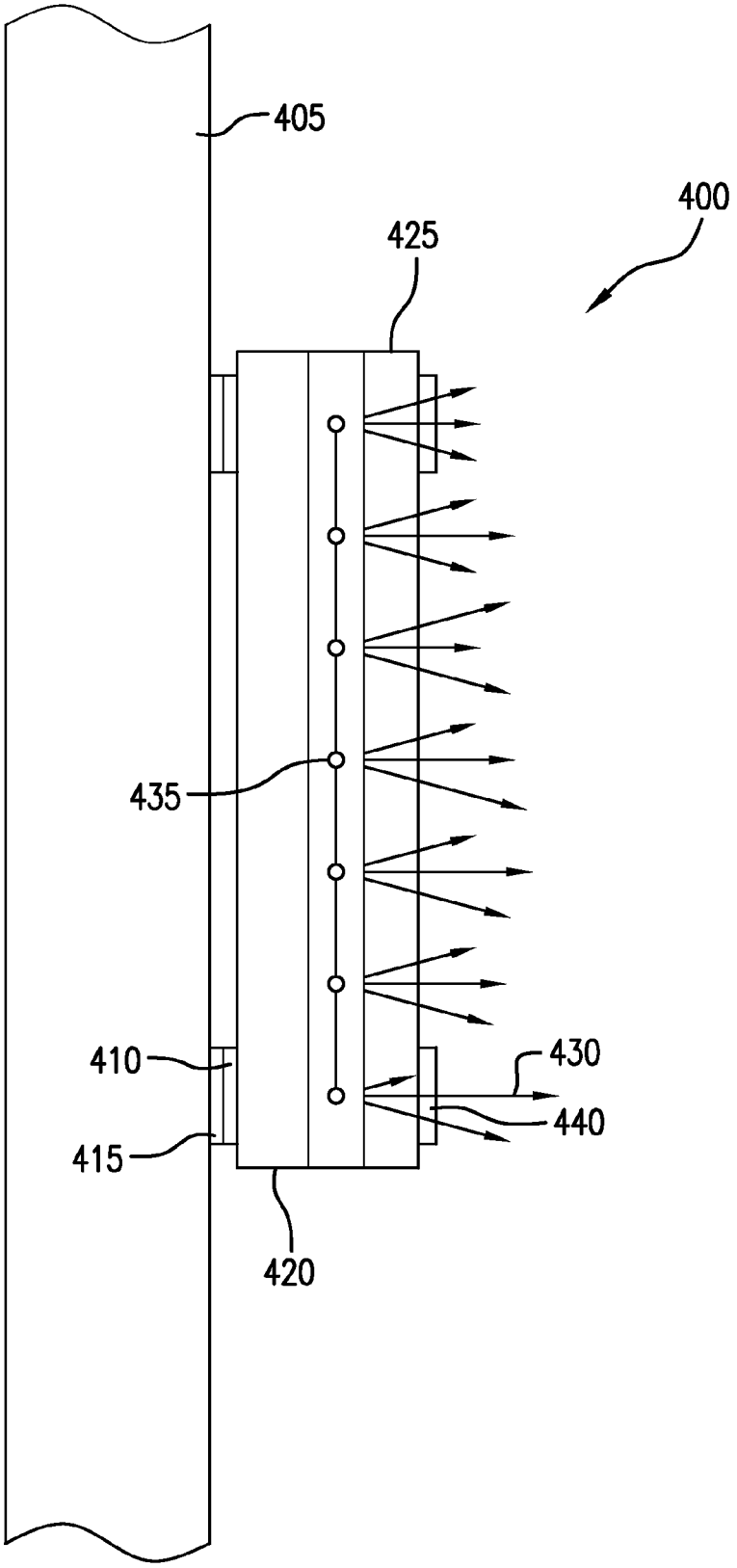
FIG. 4 depicts a side cross-sectional of another exemplary safety device attached to an article of clothing.

FIG. 4 depicts a side cross-sectional of another exemplary safety device attached to an article of clothing. The safety device 400 is portrayed as being removably attached to an article of clothing 405 via mating hook and loop fasteners 410, 415. The hook and loop fasteners 410, 415 are depicted as being attached to a first side 420 of the safety device 400 and the article of clothing 405 such that the first side 420 faces the article of clothing 400 and a second side 425 faces outward to permit light passage 430 from a lighting assembly 435 therethrough. In the depicted example, a mating hook or loop fastener 440 may also be secured to the second side 430 to permit the safety device 400 to be flipped and secured in a flipped arrangement.

Figure 5:
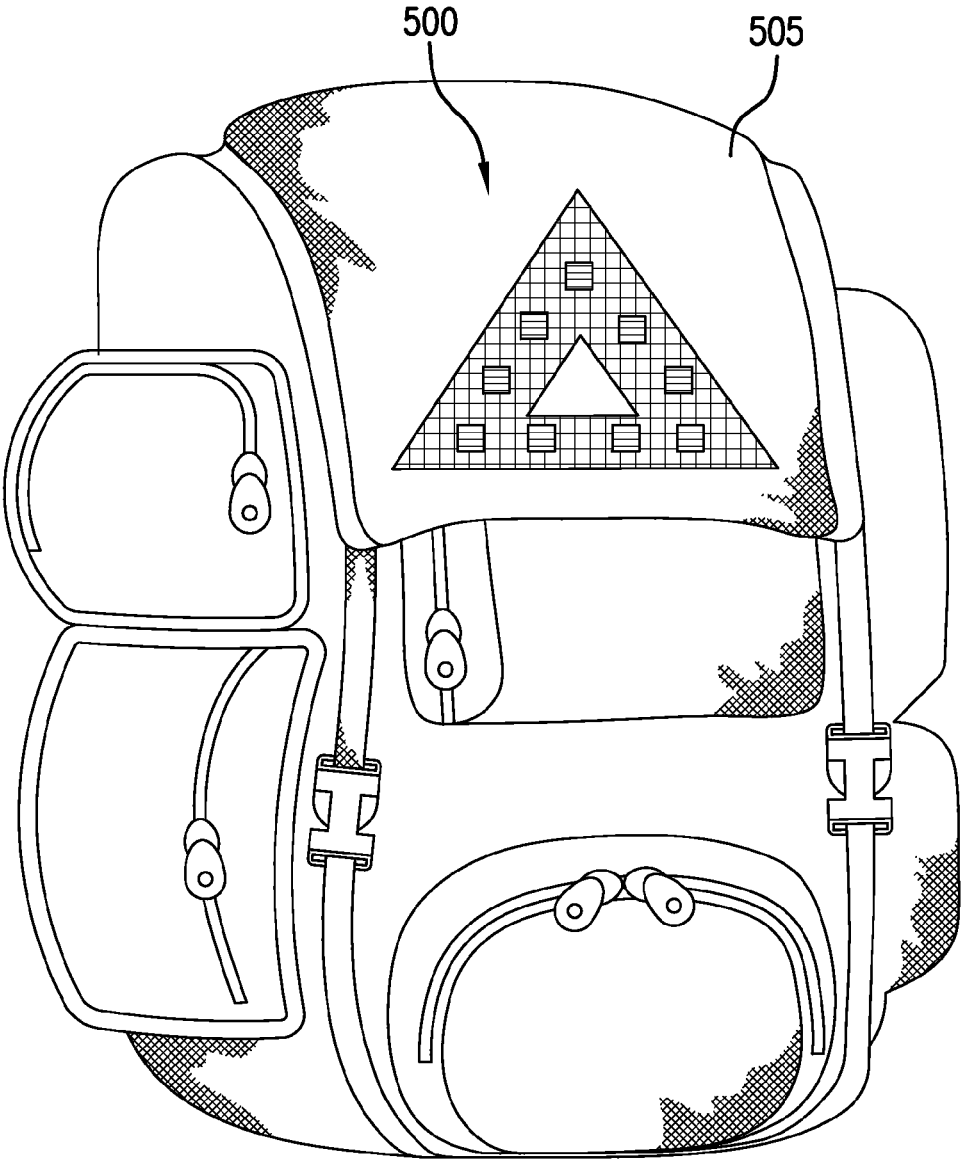
FIG. 5 depicts an exemplary safety device attached to a backpack.

FIG. 5 depicts an exemplary safety device attached to a backpack. In the depicted example, a safety device 500 is attached to the outer front of a backpack 505.

Although various embodiments have been described with reference to the Figures, other embodiments are possible. For example, the safety device may include a first layer having a triangular shape and a second layer having a triangular shape with the first layer and the second layer attached back-to-back. Between the first layer and the second layer a lighting assembly may be retained for shining a shared light through the first layer and the second layer. In an exemplary embodiment, only the light shining through the first layer or the second layer is visible since the opposite layer is attached to an object. In an exemplary embodiment, a removable attachment structure is used to attach the safety device to an object to permit for flipping the safety device to expose the opposite side or layer, and to permit detachment of the safety device from a first object and reattachment of the safety device to a second object.

Figure 6:
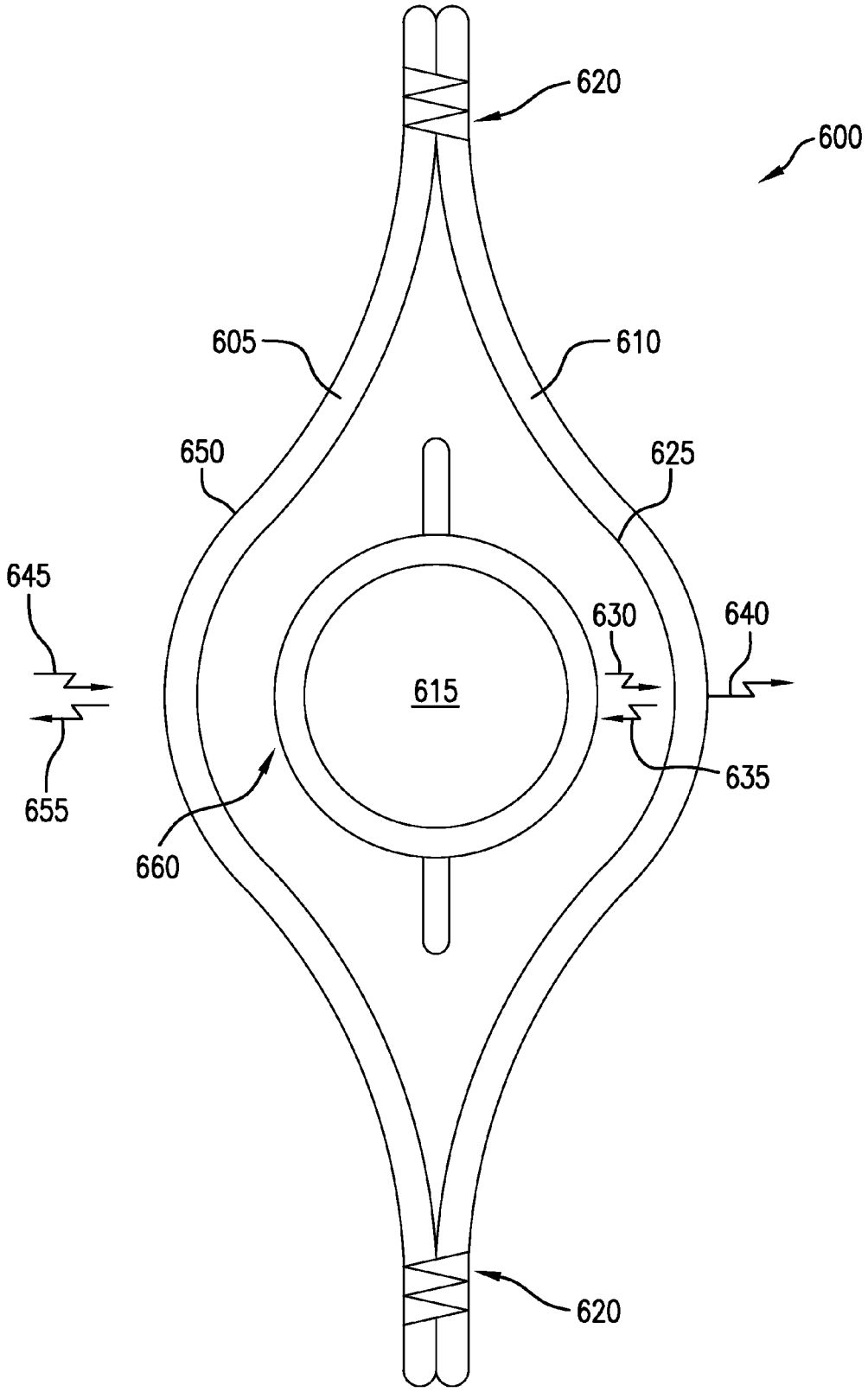
FIG. 6 depicts a schematic depiction of light illumination of an exemplary safety device. Like reference symbols in the various drawings indicate like elements.

FIG. 6 depicts a schematic depiction of light illumination of an exemplary safety device. In the FIG. 6 depiction, a portion 600 of a safety device is shown in cross-section. The portion 600 of the safety device includes a first outer layer 605 and a second outer layer 610. A light emitting device 615 is sandwiched between the first outer layer 605 and the second outer layer 610. A perimeter coupling 620 secures the first outer layer 605 to the second outer layer 610. The light emitting device 615 is contained within the perimeter coupling 620. The light emitting device 615 may emit light 630 directed toward an inside surface 625 of the second outer layer 610. A reflected portion 635 of the emitted light 630 may reflect back toward the light emitting device 615. A transmitted portion 640 of the emitted light 630 may transmit through the second outer layer 610. An external light beam 645 may be incident upon an exterior surface 650 of the first outer layer 605, for example. A reflected portion 655 of the external light beam 645 may be reflected by the first outer layer 605.

In some embodiments the first 605 and second 610 outer layers may have a high coefficient of reflection on the layers' outside surfaces 650, for example. In some embodiments, the first 605 and second 610 outer layers may have a high coefficient of transmission from the layers' inside surfaces 625 to the layers' outside surfaces 650. In an exemplary embodiment, the sandwich structure of the first 605 and second 610 outer layers may present a light pipe structure. A light pipe structure may permit the light to reflect back and forth within a cavity 660, building up light energy. The light energy may build up until the transmission and absorption of light through and within the first 605 and second 610 outer layers substantially equals the light emitted by the light emitting device 615. When substantially equality between light transmission and absorption and light emission exists, steady state operation may result.

In some embodiments, the hook and loop fasteners may be secured to the safety device as needed. For example, a user may secure a hook fastener to the article of clothing and a mating loop fastener to the first side of the safety device if using the second side to emit light. If the user desired to emit light through the first side, the mating loop fastener of the first side may be removed from the first side and attached to the second side to secure the second side adjacent the article of clothing. In other exemplary embodiments, the safety device is attached to an object via a zipper assembly.

In accordance with another embodiment, the safety device may include multiple types of attachment structures for securing the safety device to an object. For example, the safety device may include magnets for permitting a magnetic attractant and may also include a hook and loop fastener arrangement for a VELCRO type attachment. In some embodiments, the safety device may be secured to an object via one or more safety pins. In some embodiments, the safety device may have an adhesive layer along the first layer and/or the second layer. The adhesive layer may include a removable backing, such that once the backing is removed on a particle side or layer the adhesive layer may be attached to the object. In an exemplary embodiment, the magnets may be a N35/Ni (size: D12.7×1.58 mm) neodymium magnet.

In various embodiments, apparatus and methods may involve a tubing structure internal to the safety device and extending from the first layer to the second layer. The tubing structure may direct and emit light through the first and second layers. In an exemplary embodiment, the tubing structure may include an internal lining having reflective properties to concentrate the light and thus provide a more visible safety device. In some embodiments, each LED in an LED string of the safety device may include a separate tubing structure. In some embodiments, each tube extends completely through the first layer and the second layer. In some embodiments, each tube abuts the interior surfaces of the first layer and the second layer, wherein the first layer and the second layer are translucent to permit light passage. In some embodiments, the first layer and the second layer are transparent to permit a greater degree of light passage.

In accordance with another embodiment, the safety device includes an internal power supply. The internal power supply may include rechargeable batteries in some embodiments. In other embodiments, the power supply may be comprised or non-rechargeable batteries. In some examples, the power supply is comprised of lithium batteries. In some embodiments, the power supply may be a super capacitor. In an exemplary embodiment, the power supply, light string, and other internal circuitry may be waterproof. In some exemplary embodiments, the LED string may include 5 or 6 LEDs along each leg of a triangle. In an exemplary embodiment, the LEDs may be a type 0603. In some embodiments, the controller may include a plurality of control buttons or switches to send different commands or signals to the LEDs. In some exemplary embodiments, the safety device may include an audible warning or sound.

In accordance with an exemplary embodiment, the first layer may include a plurality of first holes and the second layer may include a plurality of second holes. The first holes and the second holes may align with a plurality of shared LEDs between the first layer and the second layer. The first layer and the second layer may be formed of a reflective material which restricts light passage. The first holes and the second holes permit the light passage through the first layer and the second layer. In an exemplary embodiment, a translucent material may cover the first holes and the second holes. The translucent material covering the first holes may be orange in color to cause an orange light to be emitted through the first holes and the translucent material covering the second holes may be yellow in color to cause a yellow light to be emitted through the second holes.

In accordance with an exemplary embodiment, the first layer may include a plurality of first holes and the second layer may include a plurality of second holes. The first holes may align with a plurality of first LEDs and the second holes may align with a plurality of second LEDs. In an exemplary embodiment, the first LEDs extend through the first holes and the second LEDs extend through the second holes. In some embodiments, the first LEDs may be separately controlled from the second LEDs. In some exemplary embodiments, the first LEDs may include a colored lens of a first color and the second LEDs may include a colored lens of a second color. In some examples, the first color is orange and the second color is yellow.

In some exemplary embodiments, the color emitted from the first layer or side may be blue and the color emitted from the second layer or side may be blue, such as to provide a patriotic themed safety device. In other exemplary embodiments, the color emitted from the first layer or side may be green and the color emitted from the second layer or side may be red, such as to provide a holiday or Christmas themed safety device. In some exemplary embodiments, the safety device may include internal circuitry to permit for the emitted light color to change from yellow to orange to blue, for example.

In some exemplary embodiments, a translucent and reflective coefficient of the first layer may be different from the translucent and reflective coefficient of the second layer. For example, the first layer may have a greater transparency than the second layer to permit more light passage from the internal LEDs and less reflective properties. The second layer may include a higher reflective coefficient to reflect more ambient light and restrict more light passage than the first layer. In some embodiments, the first layer which may have a higher translucent coefficient may be used primarily at night. For example, a user may deem it more important to provide a lighted safety device rather than rely on ambient light to illuminate the reflective portion of the safety device. Some instances that may prove favorable to a higher translucent coefficient are cloudy nights or areas with minimal vehicle traffic and thus minimal headlights to provide ambient light. In some embodiments, the second layer which may have a higher reflective coefficient may be used primarily during the day. For example, a user may deem it more important to reflect ambient light during the day since the LEDs may be difficult to see for passing vehicles, since the sunlight may be brighter than the LEDs.

In some exemplary embodiments, the safety device may be a garment-attachable version, such as for example to attach and detach to a running shirt. In some exemplary embodiments, the safety device may be embedded in reversible sports clothing.

In some exemplary embodiments, the safety device may enhance the visibility of the wearer and alert vehicles of the wearer's location. The safety device may temporarily transfer and fasten to clothing or accessories. In some exemplary embodiments, a strip of waterproof LEDs may be contained within two reflective layers. For example, the safety device may be reversible such as to portray either the first reflective layer or the second reflective layer. The LEDs may operate off of a small light weight battery compartment contained within the two flexible and reflective layers. In some exemplary embodiments, the reflective layers may be formed via a plurality of reflective tape strips.

In some exemplary embodiments, the entire first layer and second layer have translucent and reflective properties such as to emit light as a solid triangle. In other exemplary embodiments, the first layer and/or the second layer may include a hollow center, such as to emit light as hollow triangle. In some exemplary embodiments, portions of the first layer and/or second layer may be translucent and portions of the first layer and/or second layer may be reflective. For example, an outer perimeter of the first layer and/or second layer may be a reflective material, while a more central portion of the first layer and/or second layer may be translucent.

In an exemplary embodiment an outer layer may have properties of reflection, absorption and transmission. For example, an exemplary outer layer may have a coefficient of reflection of about 0.25, 0.4, 0.5, 0.7, 0.8, or about 0.9, for example. The exemplary outer layer may have absorption properties that are a function of wavelength. For example, the outer layer may absorb some frequencies more than it absorbs other frequencies. Such spectral absorption properties may give the outer layer an appearance of color, for example. In some embodiments, light the outer layer may permit some transmission of light there-through. For example, an inside surface of an exemplary outer layer may be illuminated. A portion of the light incident upon the inside surface may transmit through the outer layer and emerge from an outer surface. The outer surface, in some embodiments may be a reflective surface, for example. The outer layer may have a transmission coefficient of about 0.1, 0.15, 0.25, 0.3, 0.35, or about 0.4, for example.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An illuminated safety device for attachment to an article of clothing, the illuminated safety device comprising:

a first outer layer having a safety symbol shape, said first outer layer having a first non-zero coefficient of transmission from an inside surface to an outside surface and a first non-zero coefficient of reflection of said outside surface;

a second outer layer having said safety symbol shape and coupled to said first outer layer via a perimeter coupling such that the first outer layer directly contacts the second outer layer at the perimeter coupling, said second outer layer having a second non-zero coefficient of transmission from an inside surface to an outside surface and a second non-zero coefficient of reflection of said outside surface;

a lighting assembly within said perimeter coupling and sandwiched between said insides surfaces of both said first outer layer and said second outer layer; and, a magnetic attachment element sandwiched between inside surfaces of both said first outer layer and said second outer layer, wherein said illuminated safety device is attachable to a garment in one of two modes, wherein, in a first mode, said first outer layer and said garment are sandwiched between said magnetic attachment element and said magnetic permeable module, wherein, in a second mode, said second outer layer and said garment are sandwiched between said magnetic attachment element and said magnetic permeable module.

2. The illuminated safety device of claim 1, wherein said safety symbol shape of said first outer layer is a warning triangle symbol.

3. The illuminated safety device of claim 1, wherein said first non-zero coefficient of transmission is greater than 0.25.

4. The illuminated safety device of claim 1, wherein said first non-zero coefficient of reflection is greater than 0.5.

5. The illuminated safety device of claim 1, wherein said lighting assembly comprises one or more strings of LEDs.

6. The illuminated safety device of claim 1, wherein said first outer layer is comprised of a first color such that light emitted from said lighting assembly and transmitted through said first outer layer from said first inside surface to said first outside surface is representative of said first color and wherein said second outer layer is comprised of a second color such that light emitted from said lighting assembly and transmitted through said second outer layer from said second inside surface to said second outside surface is representative of said second color.

7. The illuminated safety device of claim 6, wherein said first color is orange and wherein said second color is yellow.

8. The illuminated safety device of claim 1, including a power supply and a controller electrically connected to said lighting assembly.

9. An illuminated safety device for attachment to an article of clothing, comprising:

a safety symbol having a first layer peripherally coupled to a second layer defining an inside cavity and an outside space, the first and second layers being light transmissive from the cavity through the first and second layers to the outside space, the first and second layers being light reflective from the outside space;

a light source contained with the cavity of the safety symbol; and a magnetic attachment structure connected to said safety symbol, said magnetic attachment structure for securing said safety symbol to an article of clothing via a magnetic permeable member, wherein the first layer directs contacts the second layer when peripherally coupled.

10. The illuminated safety device of claim 9, wherein said magnetic attachment structure includes a plurality of first magnets and a plurality of second magnets, wherein said plurality of first magnets are within the cavity, and wherein said plurality of second magnets are adapted to sandwich the article of clothing between said plurality of second magnets and said safety symbol such that said plurality of second magnets are magnetically coupled to said plurality of first magnets.

11. The illuminated safety device of claim 9, wherein at least 20% of light emitted from said light source is transmitted through said first layer.

12. The illuminated safety device of claim 9, wherein at least 30% of light emitted from said light source is transmitted through said second layer.

13. The illuminated safety device of claim 9, wherein at least 40% of light from said outside space and incident upon said first layer is reflected.

14. The illuminated safety device of claim 9, wherein at least 75% of light from said outside space and incident upon said second layer is reflected.

15. An illuminated safety device for attachment to an article of clothing, comprising:

a reflective safety symbol having a first reflective layer, a second reflective layer, a light source positioned between said first reflective layer and said second reflective layer, and a power supply electrically connected to said light source; and a means for removably attaching of said safety symbol to an article of clothing such that when said first reflective layer faces outward from said article of clothing said second reflective layer faces inward towards said article of clothing and such that when said second reflective layer faces outward from said article of clothing said first reflective layer faces inward towards said article of clothing, wherein the first reflective layer couples to the second reflective layer via a perimeter coupling such that the first reflective layer directly contacts the second reflective layer at the perimeter coupling.

16. The illuminated safety device of claim 15, wherein said means for removably attaching comprises a magnetic attachment structure.

17. The illuminated safety device of claim 15, wherein said means for removably attaching comprises a hook and loop attachment structure.

18. The illuminated safety device of claim 15, wherein said first reflective layer includes a first reflective surface on an exterior side and wherein said second reflective layer includes a second reflective surface on an exterior side.

19. The illuminated safety device of claim 15, wherein said first reflective layer is comprised of a first color such that said emitted light through said first reflective layer from said light source is representative of said first color and wherein said second reflective layer is comprised of a second color such that said emitted light through said second reflective layer from said light source is representative of said second color.

20. The illuminated safety device of claim 15, wherein said reflective safety symbol is configured as a warning triangle shape.

* * * * *